US010271710B2

(12) United States Patent
Wegner

(10) Patent No.: US 10,271,710 B2
(45) Date of Patent: Apr. 30, 2019

(54) DRYING RACK

(71) Applicant: Kohler Co., Kohler, WI (US)

(72) Inventor: Matthew R. Wegner, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/801,661

(22) Filed: Nov. 2, 2017

(65) Prior Publication Data

US 2018/0116485 A1 May 3, 2018

Related U.S. Application Data

(60) Provisional application No. 62/417,240, filed on Nov. 3, 2016.

(51) Int. Cl.
*A47L 15/50* (2006.01)
*A47L 19/04* (2006.01)

(52) U.S. Cl.
CPC ..... *A47L 19/04* (2013.01); *A47L 15/503* (2013.01); *A47L 15/504* (2013.01); *A47L 15/506* (2013.01)

(58) Field of Classification Search
CPC ..... A47L 19/04; A47L 19/02; A47L 15/501; A47L 15/50; A47L 15/503; A47L 15/502; A47L 15/504; A47L 15/505; A47L 15/506; A47L 15/507; A47L 15/508; A47B 81/04; A47J 47/16; B65D 11/18; B65D 11/1813; B65D 11/1826; B65D 11/184; B65D 37/00; Y10S 220/907
USPC ... 211/41.6, 41.5, 41.3, 41.8, 195, 200, 202, 211/175, 153; 108/43, 145, 147; 312/228, 311; 220/9.1, 9.2, 9.3, 666
See application file for complete search history.

(56) References Cited

U.S. PATENT DOCUMENTS 3,410,328 A * 11/1968 Sasai ..... B65D 7/26 108/145
3,431,040 A * 3/1969 Little ..... A47B 81/064 312/272
5,115,822 A * 5/1992 Nichols ..... A47L 15/506 134/135
5,622,676 A * 4/1997 Lind ..... B01L 9/543 206/443
6,247,771 B1 * 6/2001 Miller ..... A47L 15/506 312/272
6,427,607 B1 * 8/2002 Palmer ..... A47B 23/043 108/43

(Continued)

*Primary Examiner* — Jennifer E. Novosad
(74) *Attorney, Agent, or Firm* — Foley & Lardner LLP

(57) ABSTRACT

A selectively deployable drying rack with selectively reconfigurable components is disclosed. The drying rack includes a base and an upper rim. The drying rack further includes linkages to move the upper rim away from and toward the base and a first removable tray and a second removable tray that are configured to fit in the base. The second removable tray may include a utensil compartment with holes, an outer wall, and an inner wall. The upper rim may include a utensil band and/or a wine glass rack. The utensil band may be moveable between a stowed position and an extended position when the utensil band is in use. The wine glass rack may be moveable between a storage position and an upright position when the utensil band is in use. The drying rack may include a stand wire to elevate the base of the drying rack above a surface.

24 Claims, 17 Drawing Sheets

(56) References Cited

U.S. PATENT DOCUMENTS

| | | | | |
|---|---|---|---|---|
| 8,087,108 | B2 * | 1/2012 | Burns | E03C 1/186 211/41.3 |
| 8,424,464 | B2 * | 4/2013 | Korpi | A47B 23/044 108/27 |
| 8,925,742 | B1 * | 1/2015 | Chitayat | A47L 19/04 211/132.1 |
| 2014/0132136 | A1 * | 5/2014 | Kilic | A47L 15/503 312/228.1 |
| 2014/0239788 | A1 * | 8/2014 | Turner | F24C 15/16 312/350 |
| 2015/0164301 | A1 * | 6/2015 | Bartloff | A47B 95/043 211/41.8 |
| 2016/0031354 | A1 * | 2/2016 | Miles | B60P 1/4414 211/1.51 |

* cited by examiner

DRYING RACK

CROSS REFERENCE TO RELATED PATENT APPLICATIONS

The present application claims the benefit of and priority to U.S. Provisional Patent Application No. 62/417,240, filed Nov. 3, 2016, the entire disclosure of which is incorporated herein by reference.

FIELD

The present invention relates generally to the field of drying racks. Specifically a rack for drying dishes and other kitchen cookware items.

SUMMARY

An embodiment relates to a selectively deployable drying rack with selectively reconfigurable components. The drying rack includes a base and an upper rim. The drying rack further includes linkages to move the upper rim away from and toward the base. The drying rack also includes a first removable tray and a second removable tray that are configured to fit in the base. The second removable tray may include a utensil compartment with holes, an outer wall and an inner wall. The upper rim may include a utensil band and/or a wine glass rack. The utensil band may be moveable between a stowed position and an extended position when the utensil band is in use. The wine glass rack may be moveable between a storage position and an upright position when the utensil band is in use. The drying rack may include a stand wire to elevate the base of the drying rack off of a surface.

The foregoing summary is illustrative only and is not intended to be in any way limiting. In addition to the illustrative aspects, embodiments, and features described above, further aspects, embodiments, and features will become apparent by reference to the drawings and the following description.

BRIEF DESCRIPTION OF THE DRAWINGS

Further features, characteristics, and advantages of the present disclosure will become apparent to a person of ordinary skill in the art from the following detailed description of embodiments of the present disclosure, made with reference to the drawings annexed, in which like reference characters refer to like elements.

DETAILED DESCRIPTION

Various aspects of the disclosure will now be described with regard to certain examples and embodiments, which are intended to illustrate but not to limit the disclosure. Nothing in this disclosure is intended to imply that any particular feature or characteristic of the disclosed embodiments is essential. The scope of protection is not defined by any particular embodiment described herein. Before turning to the figures, which illustrate exemplary embodiments in detail, it should be understood that the application is not limited to the details or methodology set forth in the description or illustrated in the figures. It should also be understood that the terminology is for the purpose of the descriptions only and should not be regarded as limiting.

Generally speaking, drying racks are limiting in the ability to dry a variety of kitchen equipment or different pieces are needed to dry different items. In addition, the drying racks can be bulky and difficult to store when not in use.

Accordingly, referring generally to the figures, disclosed herein is selectively deployable drying rack with selectively reconfigurable components to accommodate a variety of kitchen equipment, allow the drying rack to be easily stored and cleaned by providing components that can be selectively removed.

Drying Rack

Figure 1:
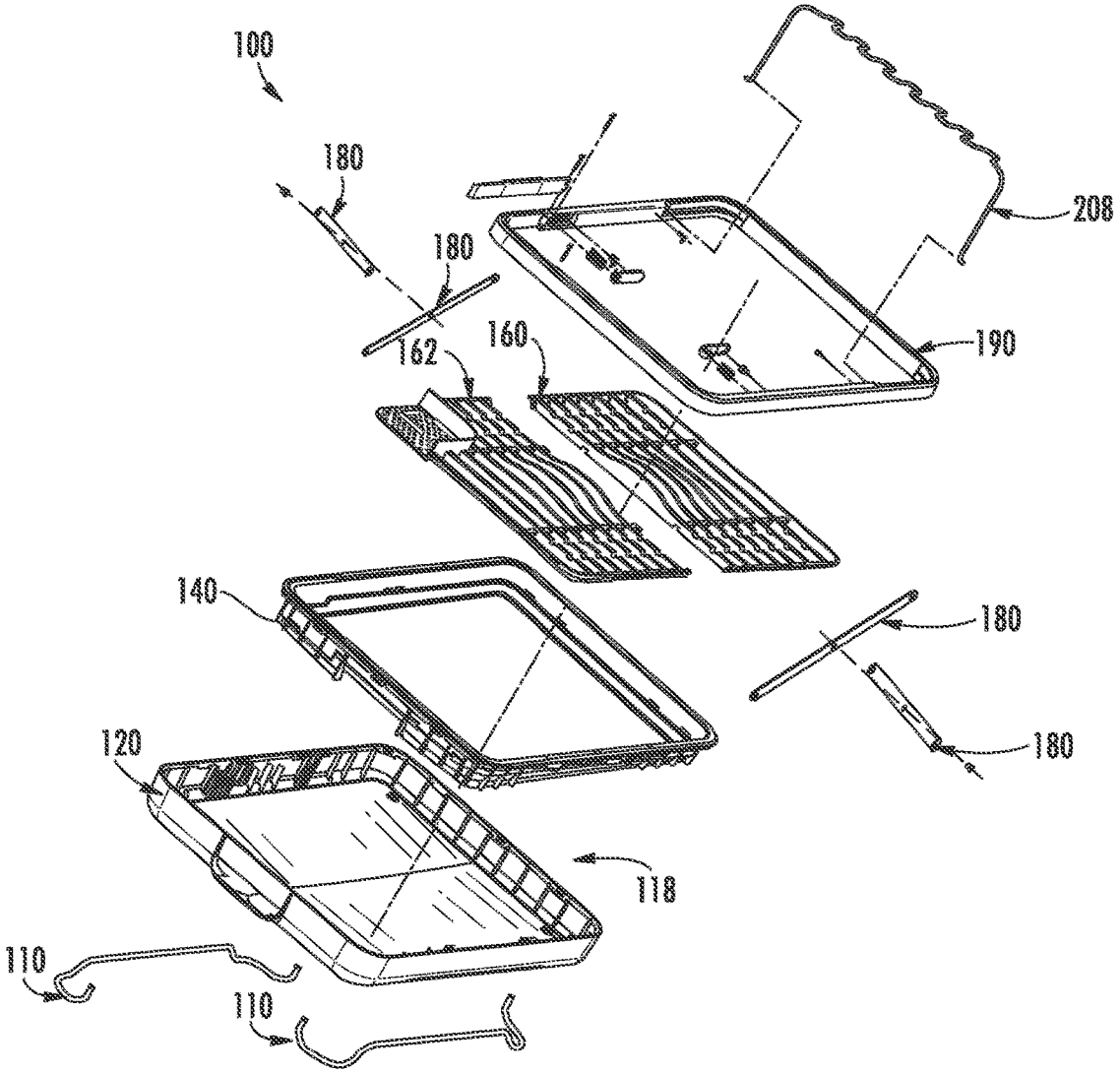
FIG. 1 is an expanded view of components of a drying rack, according to an exemplary embodiment.

Referring to FIG. 1, an expanded view of components of a selectively deployable drying rack 100 are shown, according to an exemplary embodiment. The drying rack 100 is shown to include stand wires 110, a base 118 (that includes an outer base shell 120 and an inner base rim 140), a first tray 160, a second tray 162, linkages 180, an upper rim 190 (with a utensil band 202), and a wine glass rack 208. The drying rack 100 further includes a deployment mechanism that is configured to move the upper rim 190 relative to the base 118 (i.e., to the outer base shell 120 and the inner base rim 140). The base 118 is mounted on and supported by the stand wires 110. The first tray 160 and the second tray 162 are shown to rest inside the base 118.

Various components of the drying rack 100 (i.e., the linkages and the upper rim 190, the utensil band 202, and the wine glass rack 208) are selectively and separately deployable and reconfigurable, depending on the desired configuration. For example, the linkages 180 are intended to couple the base 118 to the upper rim 190 and provides actuation between a closed (e.g., collapsed, storage, etc.) position and an open (expanded, deployed, etc.) position of the upper rim 190. The upper rim 190 supports the wine glass rack 208.

Stand Wires

Figure 2A:
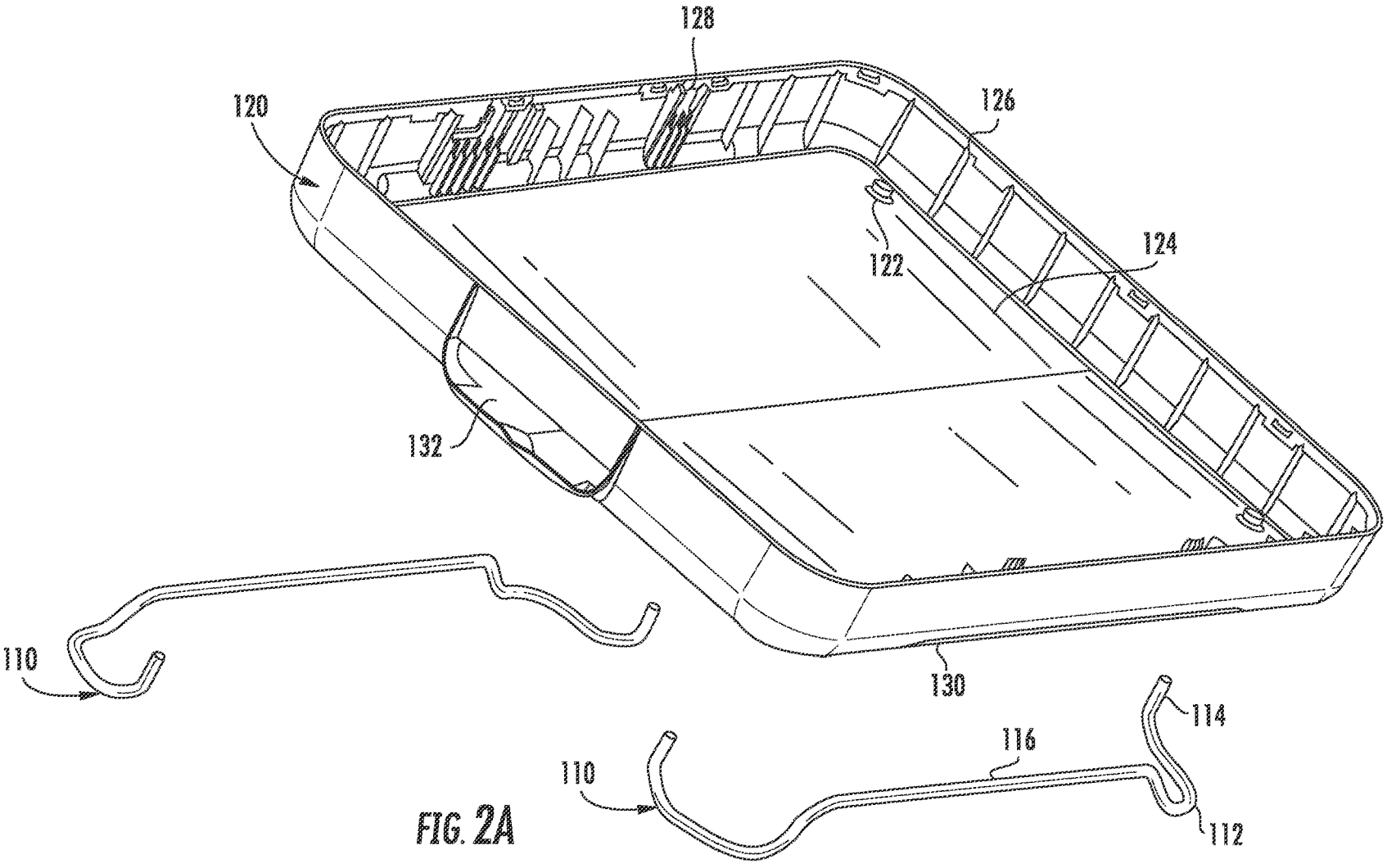
FIG. 2A is a perspective view of a schematic of an outer base shell of a base of the drying rack of FIG. 1, according to an exemplary embodiment.
Figure 2B:
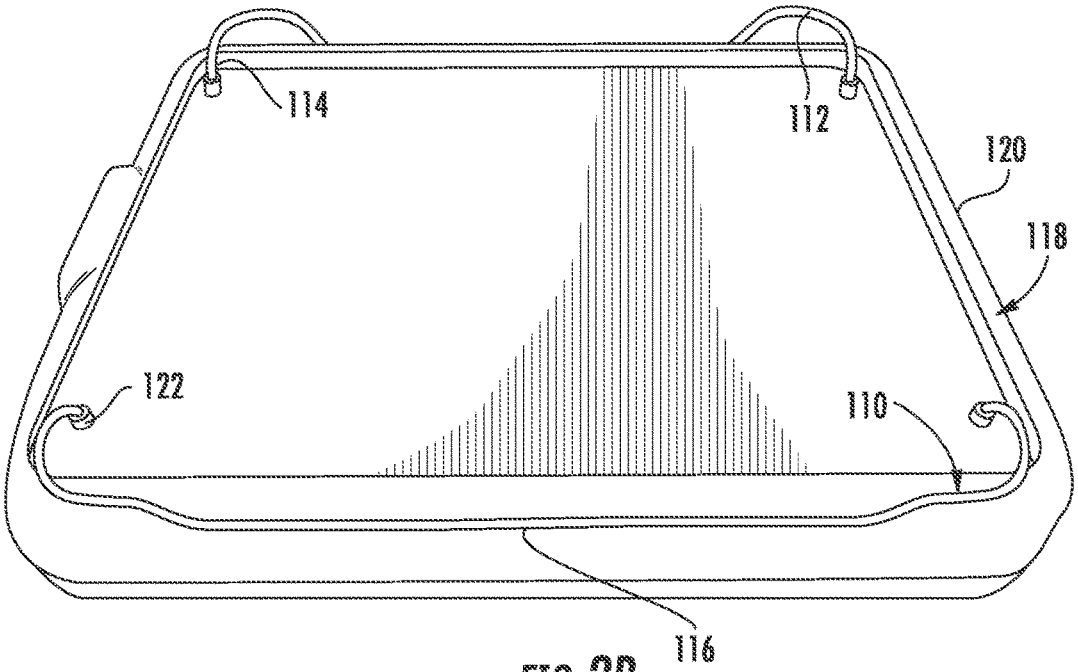
FIG. 2B is a bottom view of the base of FIG. 2A, according to an exemplary embodiment.
Figure 2C:
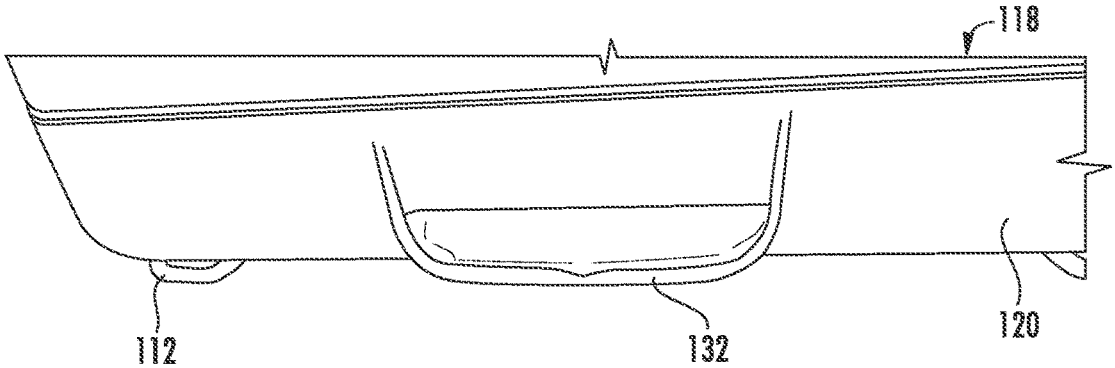
FIG. 2C is a side view of the base of FIG. 2A, according to an exemplary embodiment.

Referring to FIGS. 2A-2C, the outer base shell 120 of the base 118 and the stand wires 110 of the drying rack 100 are shown, according to an exemplary embodiment. The stand wires 110 support and elevate the base 118 of the drying rack 100 above a surface upon which the drying rack 100 is located and supported by such that there is a gap between the outer base shell 120 of the base 118 and the surface upon which the drying rack 100 is located. Each of the stand wires 110 includes risers 114, feet 112, and a locking member 116 and extend from one of the risers 114, to one of the feet 112, to the locking member 116, to another one of the feet 112, and to another one of the risers 114. The risers 114 couple the rest of the stand wire 110 to the outer base shell 120 and extend downward toward the feet 112 of the outer base shell 120. The feet 112 provide support for the drying rack 100 and rest directly on the surface upon which the drying rack 100 is located. The feet 112 are positioned toward the edges of the drying rack 100 in order to stabilize the drying rack 100 on the surface upon which the drying rack 100 is located. The feet 112 extend upward to locking member 116. The locking member 116 extends horizontally between the two feet 112 of the stand wires 110. The locking member 116 secures to the outer base shell 120 (along the length of the locking member 116) to limit movement of the stand wires 110 in relation to the base 118.

Base

The base 118 includes the outer base shell 120 and the inner base rim 140. The respective shapes and sizes of the outer base shell 120 and the inner base rim 140 are complementary to each other such that the inner base rim 140 fits within the outer base shell 120.

As shown in FIG. 2A, the outer base shell 120 of the drying rack 100 includes sockets 122, a bottom 124, sides 126, a coupling mechanism 128, a locking groove 130 and a draining spout 132. The sockets 122 are located on an underside of the outer base shell 120 and couple to the risers 114 of the stand wires 110 such that each of the risers 114 extend into a respective one of the sockets 122. The bottom 124 of the outer base shell 120 may be tapered or angled toward a centerline of the outer base shell 120 to facilitate drainage of water from the outer base shell 120. The outer base shell 120 is surrounded along its perimeter by sides 126 that are substantially perpendicular to the bottom 124. The sides 126 define the coupling mechanism 128, on an interior portion, for attaching the inner base rim 140 (as shown in FIG. 1) to the inside of the outer base shell 120. The sides 126 also define, on a lower exterior portion, the locking groove 130. The locking groove 130 secures the locking member 116 of the stand wires 110 to the rest of the outer base shell 120.

The sides 126 and the bottom 124 of the outer base shell 120 also define the draining spout 132. The tapering along the bottom 124 facilitates the movement of water toward the center of the outer base shell 120 and out of the drying rack 100 through the draining spout 132. The draining spout 132 is positioned along one of the sides of the outer base shell 120 and extends horizontally beyond the one of the sides 126 such that, when the drying rack 100 is positioned next to a sink or other basin, the draining spout 132 may be positioned over an edge of the sink or other basin (while the one of the sides 126 is next to the sink or other basin) to allow water to escape from the drying rack 100 through the draining spout 132, flow directly into the sink or other basin, and flow down a drain of the sink or other basin. In some embodiments, the draining spout 132 may also include a cover to prevent water from escaping from the drying rack 100 if a sink is not accessible.

Figure 3A:
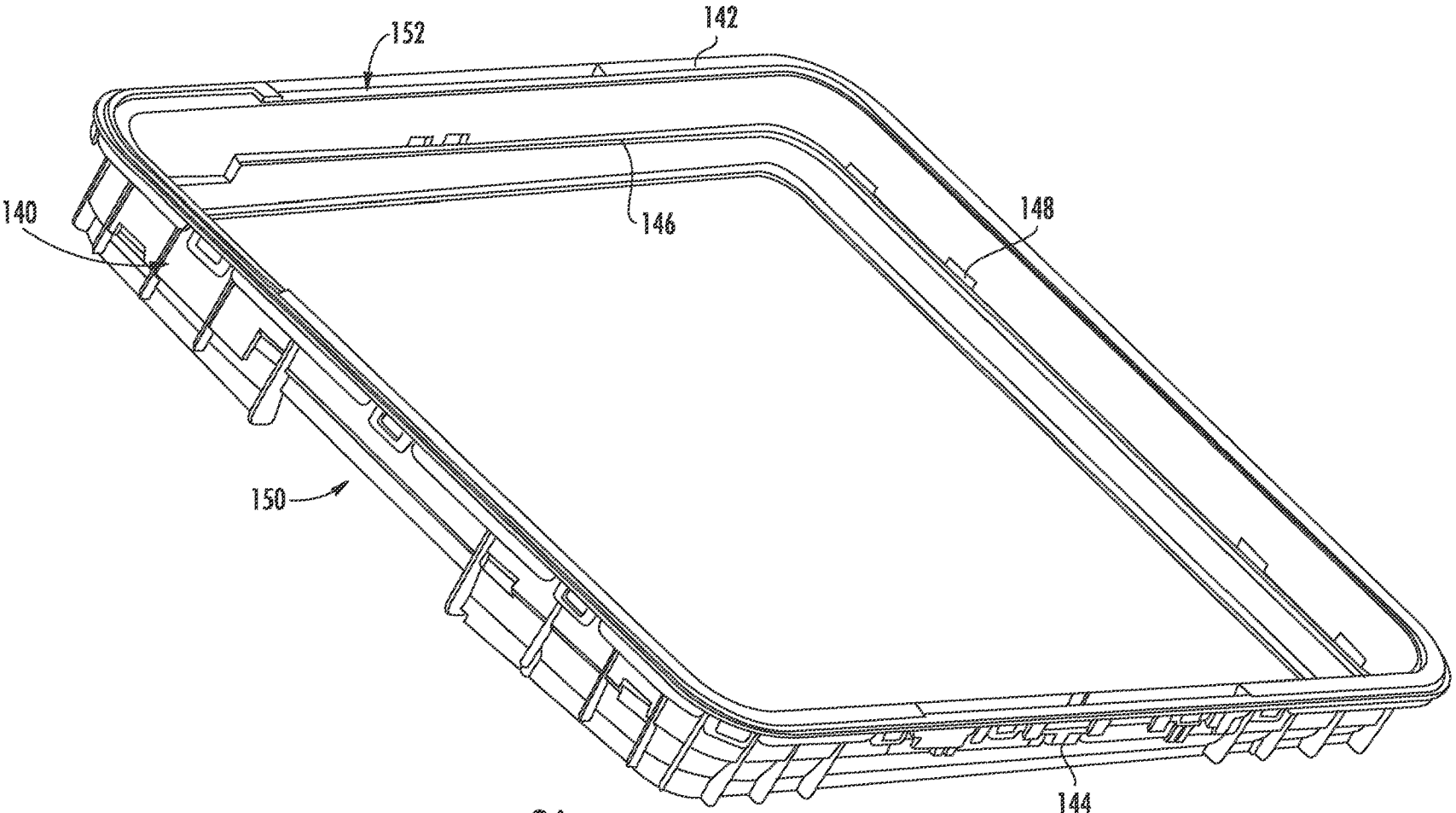
FIG. 3A is a perspective view of a schematic of an inner base rim of the base of the drying rack of FIG. 1, according to an exemplary embodiment.
Figure 3B:
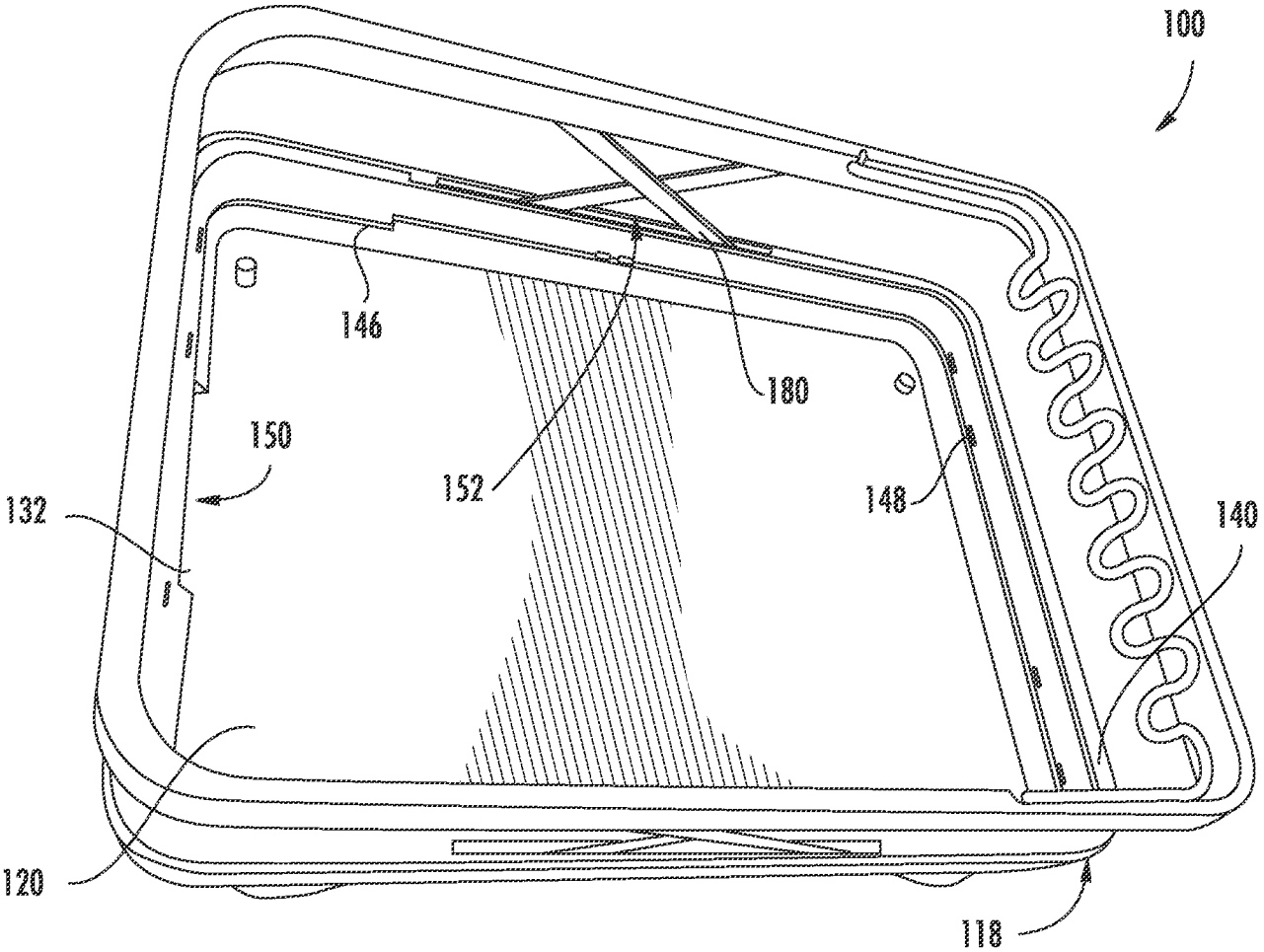
FIG. 3B is a perspective view an inner base rim of the drying rack of FIG. 1, according to an exemplary embodiment.

Referring to FIGS. 3A-3B, a perspective view of a schematic of the inner base rim 140 of the base 118 of the drying rack 100, according to an exemplary embodiment. The inner base rim 140 includes sides 142 that are substantially complementary in size and shape to the sides 126 of the outer base shell 120 such that the sides 142 fit within the sides 126 of the outer base shell 120. The sides 142 define, on an exterior portion, a coupling mechanism 144 that couples the inner base rim 140 to the outer base shell 120. In some embodiments, the outer base shell 120 and the inner base rim 140 are secured together with a pin. An interior portion of the sides 142 define a ledge 146 that allows the first tray 160 and the second tray 162, shown in FIG. 1, to rest on the inner base rim 140 above and spaced apart from the bottom of the outer base shell 120 within an interior portion of the inner base rim 140. The sides 142 also define apertures 148 that are configured to secure the first tray 160 and the second tray 162 (as shown in FIG. 1) onto the inner base rim 140. The sides 142 also define a draining spout opening 150 that is complementary to and aligns with the draining spout 132 of the outer base shell 120 such that the sides 142 of the inner base rim 140 do not interfere with the draining spout 132 of the outer base shell 120.

First Tray and Second Tray

Referring to FIGS. 1 and 4A-4C, a perspective view of the first removable tray 160 and the second removable tray 162 of the drying rack 100 are shown, according to an exemplary embodiment. The first tray 160 and second tray 162 are configured, shaped, and sized to fit within the base 118 and can be inserted into the base 118 and removed for easy cleaning. Each of the first tray 160 and second tray 162 have two supports 164 and a plurality of cross bars 168. The two supports 164 extend along an underside of the first tray 160 and the second tray 162 and the plurality of cross bars 168 extend along a direction perpendicular to the two supports 164 and intersect the two supports 164. The cross bars 168 are parallel to each other and the two supports 164 are parallel to each other.

The cross bars 168 may be spaced out from each other along the length of the two supports 164 to create gaps where dishes can be placed. The cross bars 168 may be flat along a top side or may change in height between the two supports 164. The cross bars 168 may all be uniform or may vary in height along the two supports 164. In some embodiments, the cross bars 168 increase in height towards the center of the drying rack 100 such that a height of the cross bars 168 along a center portion of the first tray 160 and the second tray 162 is larger than a height of the cross bars 168 along edge portions of the first tray 160 and the second tray 162. By varying the height of the cross bars 168, the first tray 160 and the second tray 162 are able to support a plate or other dishes in a vertical position and the two supports 164 prevent the dishes from falling through the first tray 160 and the second tray 162. By selectively varying the height in the center of the drying rack 100, dishes, such as bowls and pots, can be placed upside down and lie flat on the first tray 160 and the second tray 162. In some embodiments, the cross bars 168 include divots to allow dishes (e.g., plates, pans, etc.) to rest in the divots and lean in a direction perpendicular to the cross bars 168.

Figure 4A:
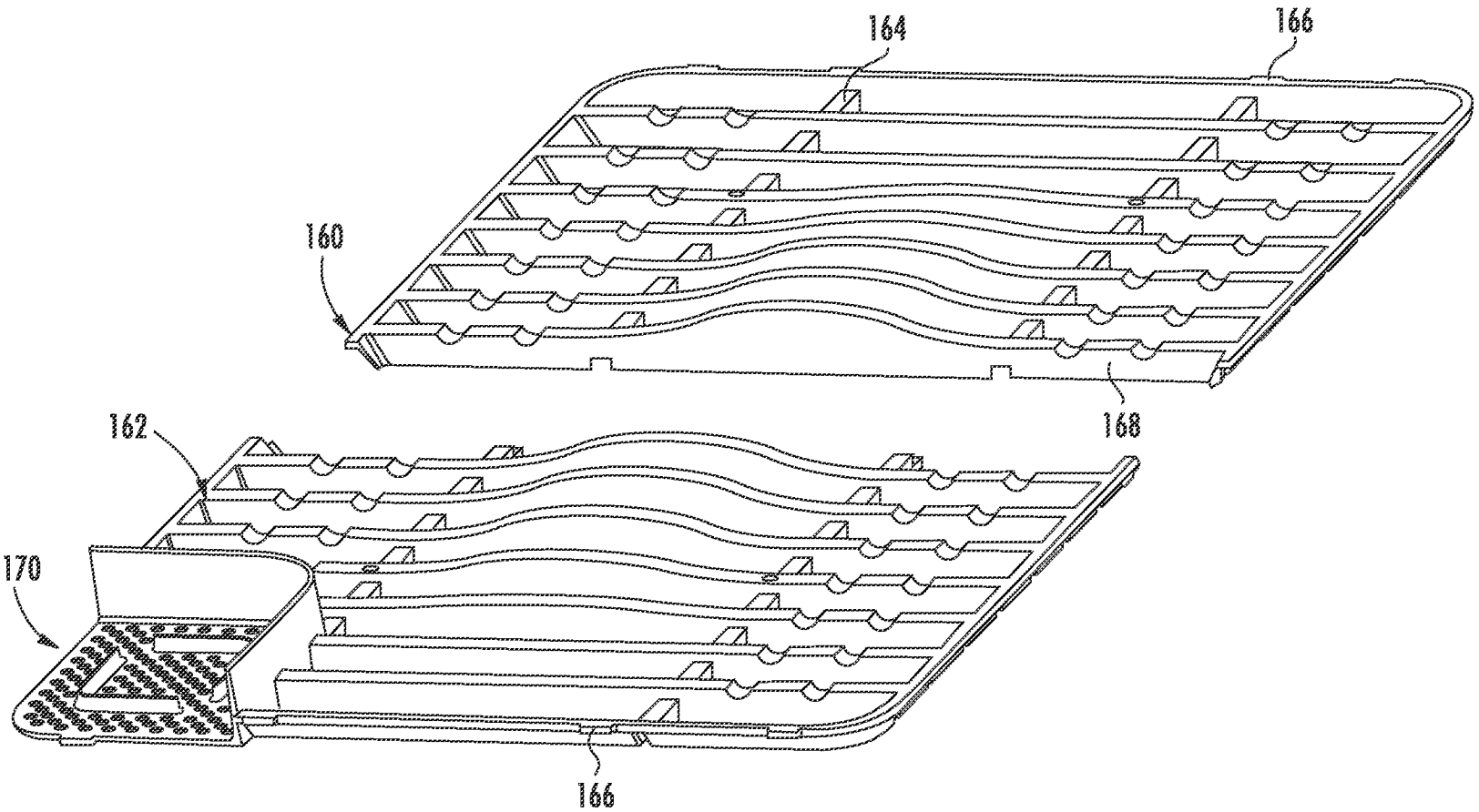
FIG. 4A is a perspective view of a schematic of removable trays of the drying rack of FIG. 1, according to an exemplary embodiment.

The first tray 160 and the second tray 162 interlock with each other such that the two support bars 162 of the second tray 162 extend underneath a portion of the first tray 160. More specifically, as shown in FIG. 4A, the two supports 164 of the first tray 160 end before the cross bars 168 such that the length of the two supports 164 is less than the width of all of the cross bars 168 in the first tray 160. The two supports 164 of the second tray 162 extend beyond the cross bars 168 such that the length of the two supports 164 is greater than than the width of all of the cross bars 168 in the second tray 162. This configuration allows the second tray 162 to be inserted first into the base 118 and rest on the ledge 146 of the inner base rim 140. The first tray 160 can then be placed into the base 118 and rest on the ledge 146 of the inner base rim 140 and will also rest on and partially overlap a portion (i.e., the two supports 164) of the second tray 162. This allows the two supports 164 to span a length of the base 118 and allows dishes to be placed anywhere along the first tray 160 and the second tray 162 without falling. Each of the first tray 160 and the second tray 162 include knobs 166 that are inserted into the apertures 148 of the inner base rim 140, shown in FIGS. 3A and 3B.

Figure 4B:
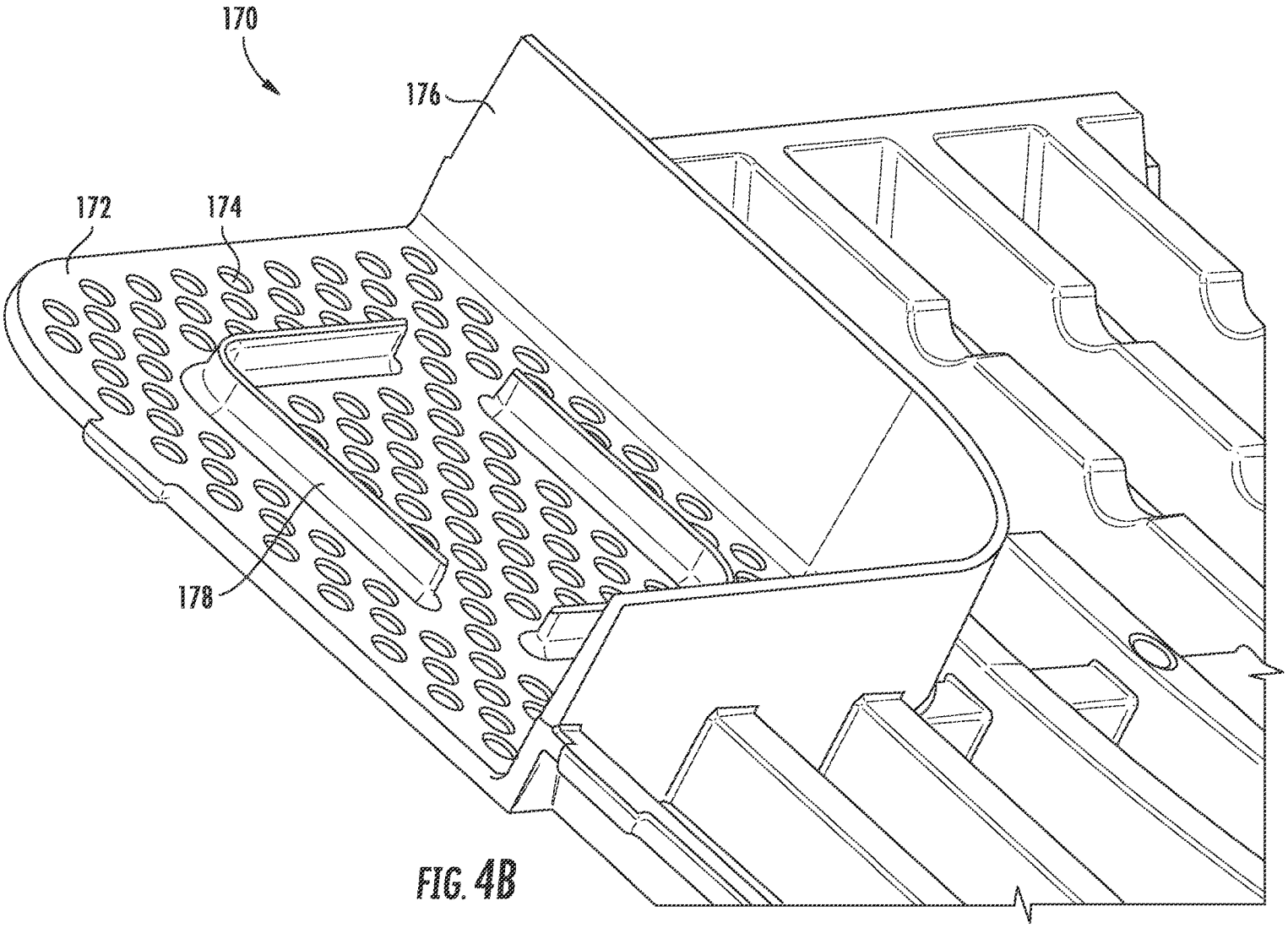
FIG. 4B is a close up schematic of a utensil compartment of the removable trays of FIG. 4A, according to an exemplary embodiment.
Figure 4C:
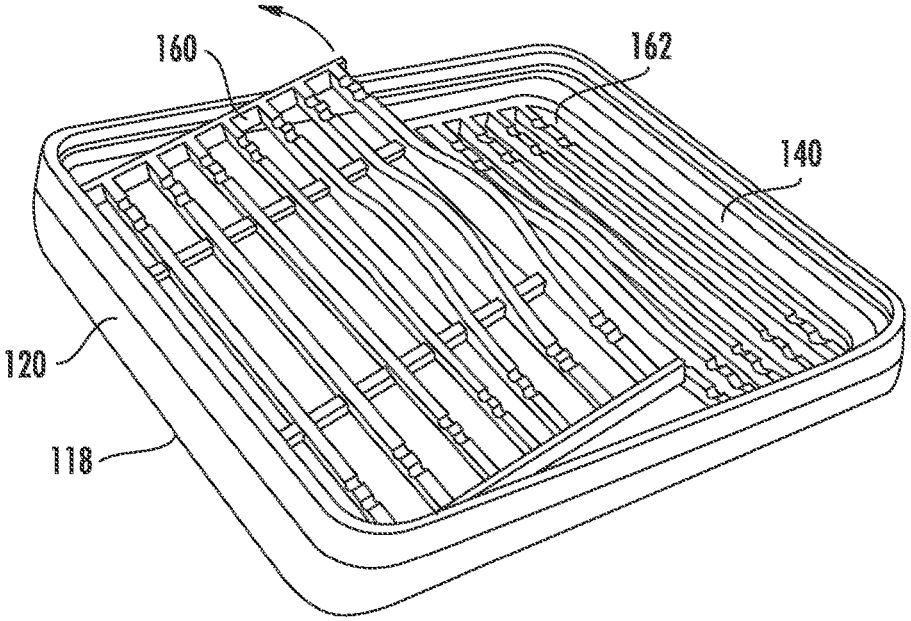
FIG. 4C is a perspective view of the drying rack of FIG. 1 with the removable trays of FIG. 4A, according to an exemplary embodiment.

The second tray 162 also includes a utensil compartment 170, as shown in FIG. 4B. The utensil compartment 170 is located in a corner of the second tray 162. The utensil compartment 170 includes a bottom 172 with a plurality of holes 174 that extend through the second tray 162. The holes 174 allow water to escape the utensil compartment 170 into the base 118. The utensil compartment 170 also includes an outer wall 176 along two sides to maintain utensils in the utensil compartment 170. The utensil compartment 170 also includes an inner wall 178. Inner wall 178 is shorter than the outer wall 176 and aids in maintaining utensils in an upright position and provides separation between utensils to minimize utensil touching each other while the utensils are drying. The inner wall 178 can include any number of walls. According to one embodiment as shown in FIG. 4B, the inner wall 178 includes 4 walls. Although the utensil compartment 170 is show on the second tray 162, it is understood that, alternatively or additionally, the first tray 160 may have a utensil compartment 170.

Deployment Mechanism

As shown in FIGS. 3A-3B and 5A-7C, the drying rack 100 also includes a deployment mechanism configured to move the upper rim 190 (as shown in FIG. 3A) between an expanded position and a collapsed position with respect to or relative to the base 118 (i.e., the outer base shell 120 and the inner base rim 140). The deployment mechanism includes the linkages 180, a spring-loaded ramp 232, pivot buttons 196, a detent 236, and sides 142 of the inner base rim 140 that also define linkage slots 152 within the inner base rim 140, as described further herein.

The linkage slots 152 of the inner base rim 140 provide an opening (e.g., a channel, etc.) to receive the linkages 180. The linkage slots 152 are intended to movably receive the lower, second ends 183 of the linkages 180 to aid in the movement of linkages 180 along the sides 142 of the inner base rim 140 in order to expand and collapse the drying rack 100 (and specifically to move the upper rim 190 up and down between an expanded position and a collapsed position relative to the base 118). The lower, second ends 183 of the linkages 180 are movably attached to the linkage slot 152 in the base 118 such that the lower, second ends 183 of the linkages 180 can move along the length of the linkage slots 152. In some embodiments, the lower, second ends 183 of linkages 180 couple to wheels (attached to a pin 231) to allow movement of the linkages 180 along a track in the linkage slots 152 in order to actuate the upper rim 190 (shown in FIG. 1) and move the upper rim 190 between the expanded position and a collapsed position. In some embodiments, all linkages 180 are coupled to wheels. In some embodiments, some linkages 180 are fixed in translation but not rotation, while other linkages are moveable in rotation and translation. According to one embodiment, the upper, second ends 183 of the linkages 180 may be lockably rotatably attached to the upper rim 190.

Linkages

Figure 5A:
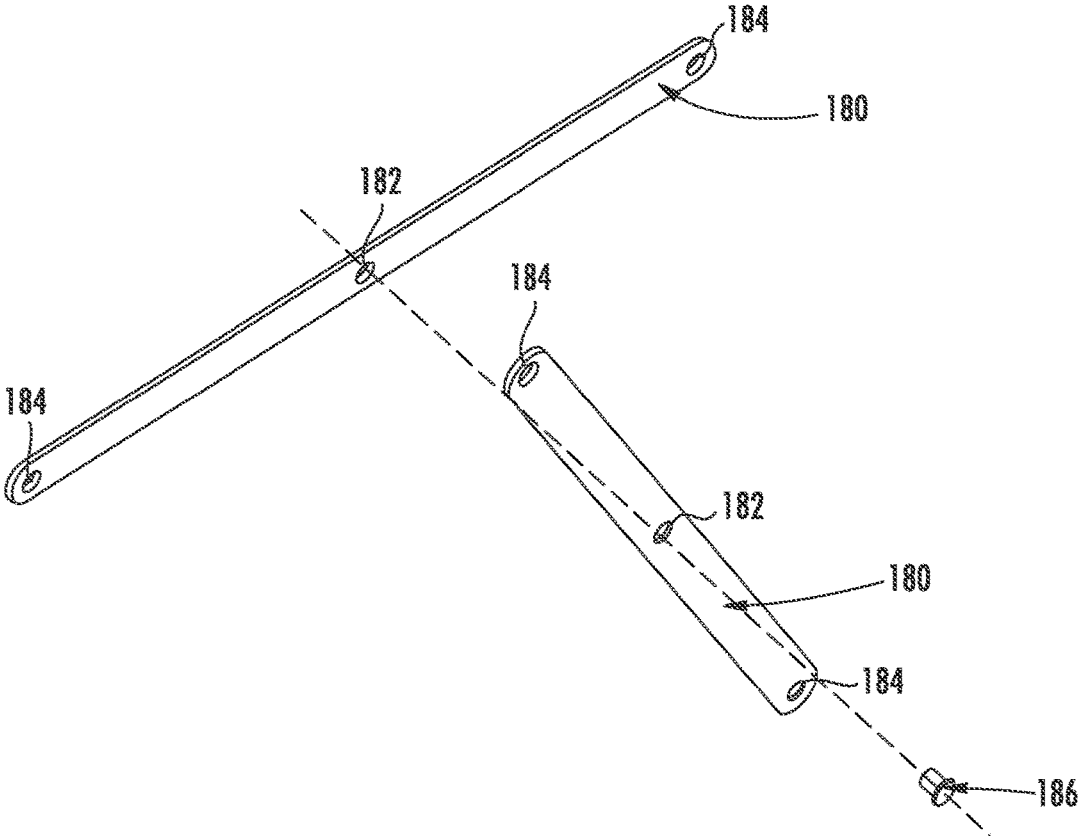
FIG. 5A is a schematic view of a linkage of the drying rack of FIG. 1, according to an exemplary embodiment.
Figure 5B:
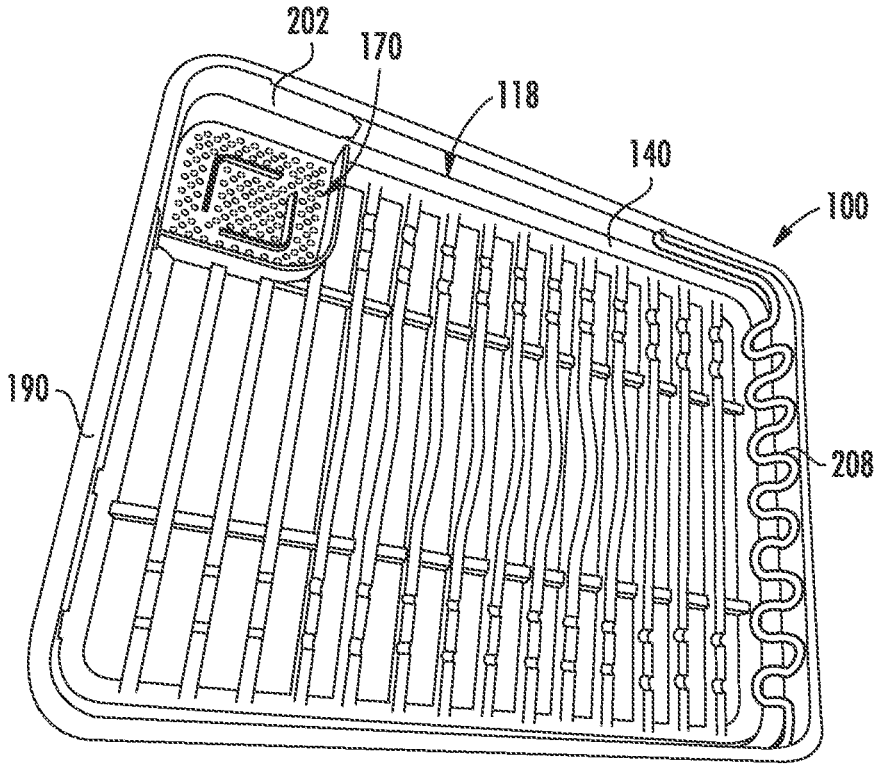
FIG. 5B is a perspective view of the linkage of FIG. 5A in a collapsed position, according to an exemplary embodiment.
Figure 5C:
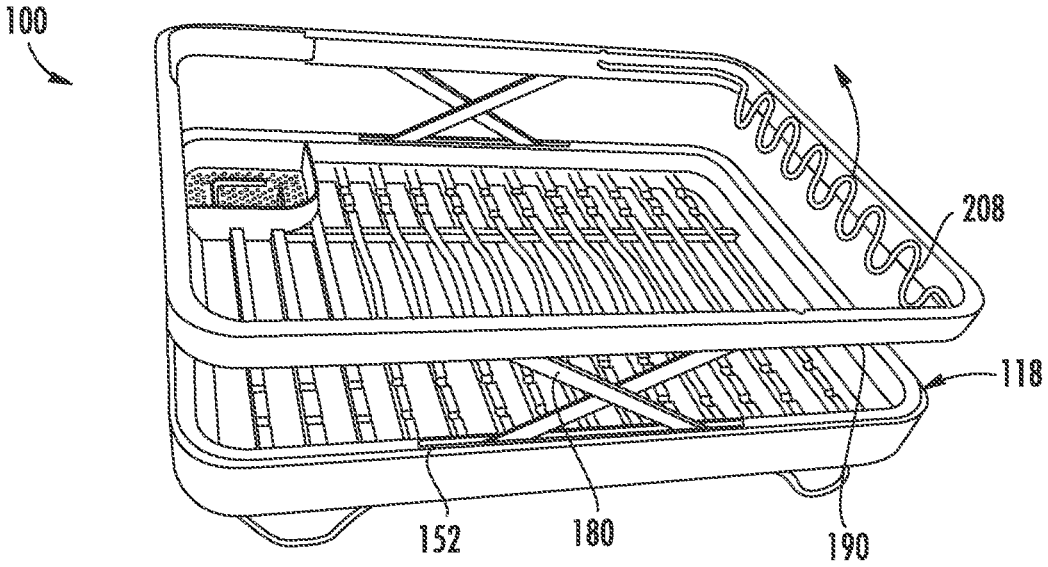
FIG. 5C is a perspective view of the linkage of FIG. 5A in an expanded position, according to an exemplary embodiment.

Now referring to FIGS. 5A-5C, the arms or linkages 180 of the drying rack 100 that enable the drying rack to move between a collapsed position and an expanded position are shown, according to an exemplary embodiment. As shown in FIG. 1, the deployment mechanism of the drying rack 100 has two pairs of linkages 180 that extend between the upper rim 190 and the base 118. The two pairs of linkages 180 are positioned along two sides of the drying rack 100. The linkages 180 include a center hole 182 and end holes 184. A rivet 186 secures two linkages 180 to one another through the center hole 182. As shown in FIG. 5A, the linkages 180 are attached to each other in a manner such that the linkages extend in opposite directions from each other in the expanded position (in, for example, an "X" shape). In the collapsed position, however, the linkages are substantially parallel to each other.

The linkages 180 allow the drying rack 100 to move between the collapsed position shown in FIG. 5B (in which the upper rim 190 is next to and abuts the inner base rim 140) and the expanded position shown in FIG. 5C (in which the upper rim 190 is spaced apart from and raised above the inner base rim 140). When in the collapsed position, the majority of the length of the linkages 180 is positioned within the linkage slots 152 to allow the inner base rim 140 and the upper rim 190 to abut each other and be as close as possible to each other. When in the expanded position, the majority of the length of the linkages 180 is extending out of the inner base 118 and the upper rim 190 in order to maximize how far apart the upper rim 190 is from the base 118.

Figure 7A:
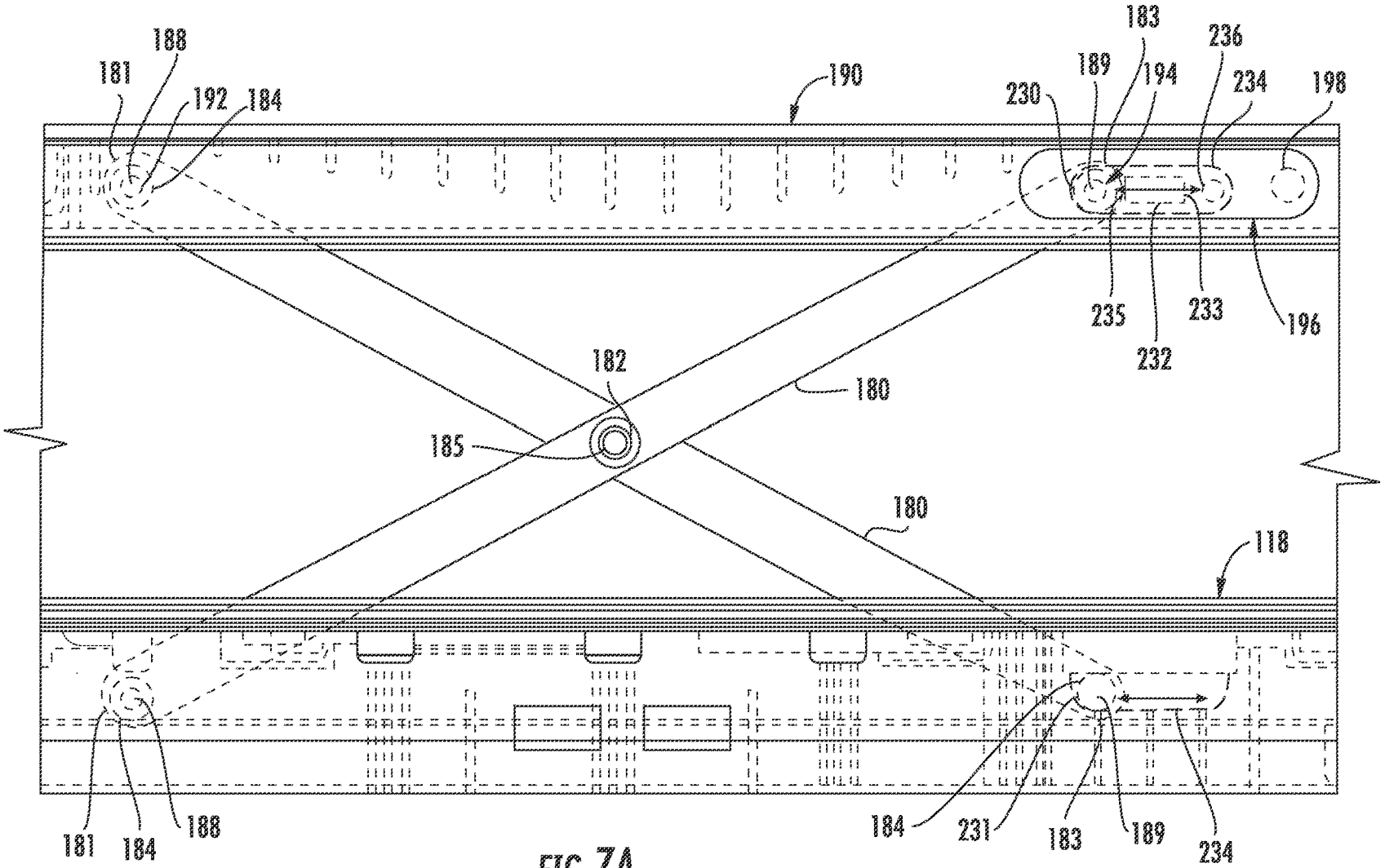
FIG. 7A is a side view of a portion of a based and an upper rim connected by linkages of the drying rack assembly of FIG. 1.

As shown in FIG. 7A, the linkages 180 comprise (and extend between) a first end 181 and a second end 183. One of the first end 181 or the second end 183 is positioned and rotatably attached to the base 118 and the other of the first end 181 or the second end 183 is positioned and rotatably attached to the upper rim 190. The two linkages 180 are oriented such that the base 118 and the upper rim 190 each have a first end 181 of one of the linkages 180 and a second end 183 of the other of the linkages 180. The upper end (either the first end 181 or the second end 183) of the linkages 180 is positioned in the upper rim 190 while the lower end (the other of the first end 181 or the second end 183) of the linkages 180 is positioned in the base 118. Middle portions of the linkages 180 are rotatably attached to each other at a rotation point 185 through the center holes 182.

The first end 181 of the each of the linkages 180 has a fixed rotation point 188, in which the first end 181 of the linkage 180 can only rotate (and not move linearly) within the base 118 or the upper rim 190. The first end 181 may rotate about a fixed pin, for example. The second end 183 of each of the linkages 180 has a slidable rotation point 189, in which the second end 183 of the linkage 180 can both rotate and move linearly back and forth within a slot 234 within the base 118 or the upper rim 190. The second end 183 may rotate about a pin (either pin 231 extending through the end hole 184 on the bottom, second end 183 or pin assembly 194 extending through the end hole 184 on the upper, second end 183) that can move linearly along the length of the slot 234 (with or without wheels 230). As shown further in FIGS. 7B-7C, the upper, second end 183 of the linkage 180 positioned within the upper rim 190 is lockable in order to secure the drying rack 100 in the collapsed position or the expanded position.

According to one embodiment, the first linkage 180 comprises an upper, first end 181 (positioned in and rotatably coupled to the upper rim 190) and a lower, second end 183 (positioned in and slidably and rotatably coupled to the base 118), and the second linkage 180 is oriented in the opposite direction of the first linkage 180 and therefore comprises a lower, first end 181 (positioned in and rotatably coupled to the base 118) and an upper, second end 183 (positioned in and slidably and rotatably coupled to the upper rim 190). Accordingly, the lower, second end 183 of the first linkage 180 is positioned within and slidably and rotatably attached to the linkage slots 152 within the base 118 such that the first linkage 180 is slidably and rotatably coupled to the outer base shell 120 and the inner base rim 140 and the lower, second end 183 of the first linkage 180 can move along the length of the linkage slot 152.

Figure 7B:
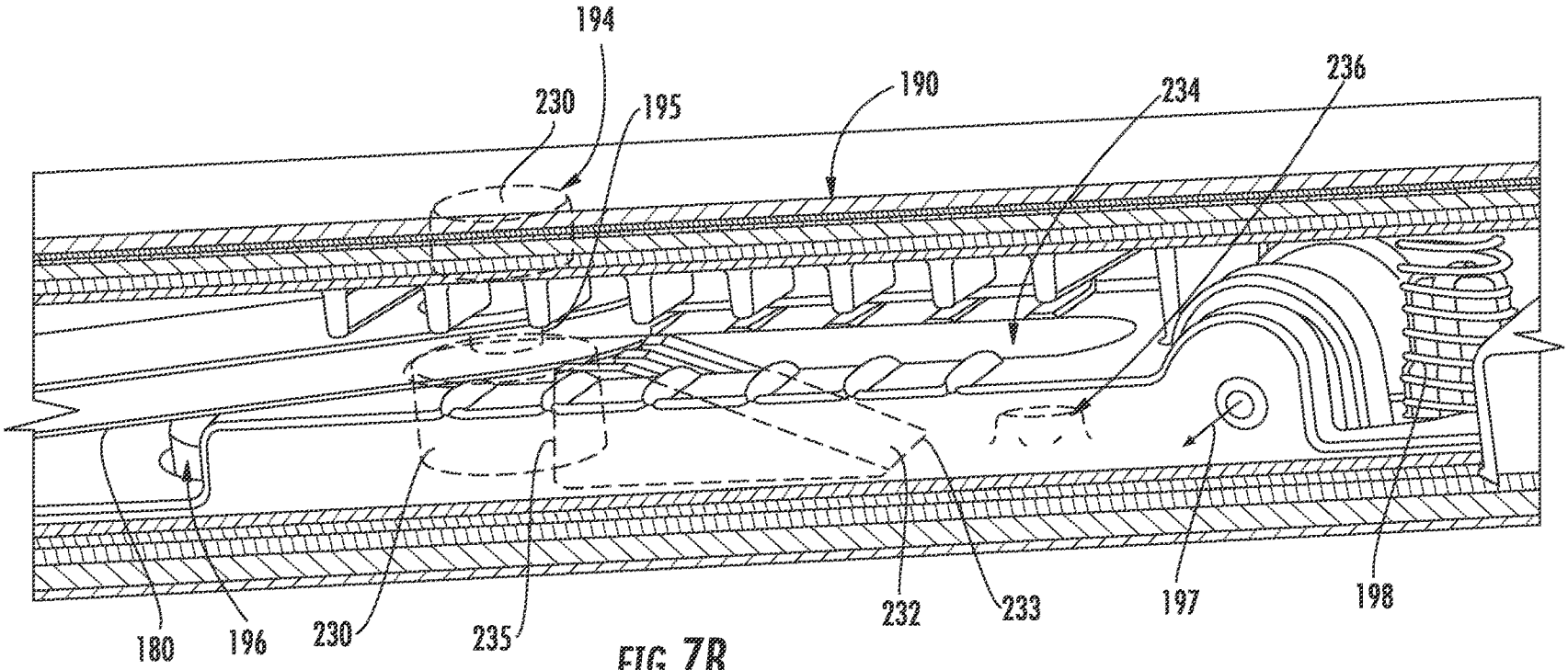
FIG. 7B is a close up, schematic, bottom perspective view of a portion of the upper rim of FIG. 7A, according to an exemplary embodiment.
Figure 7C:
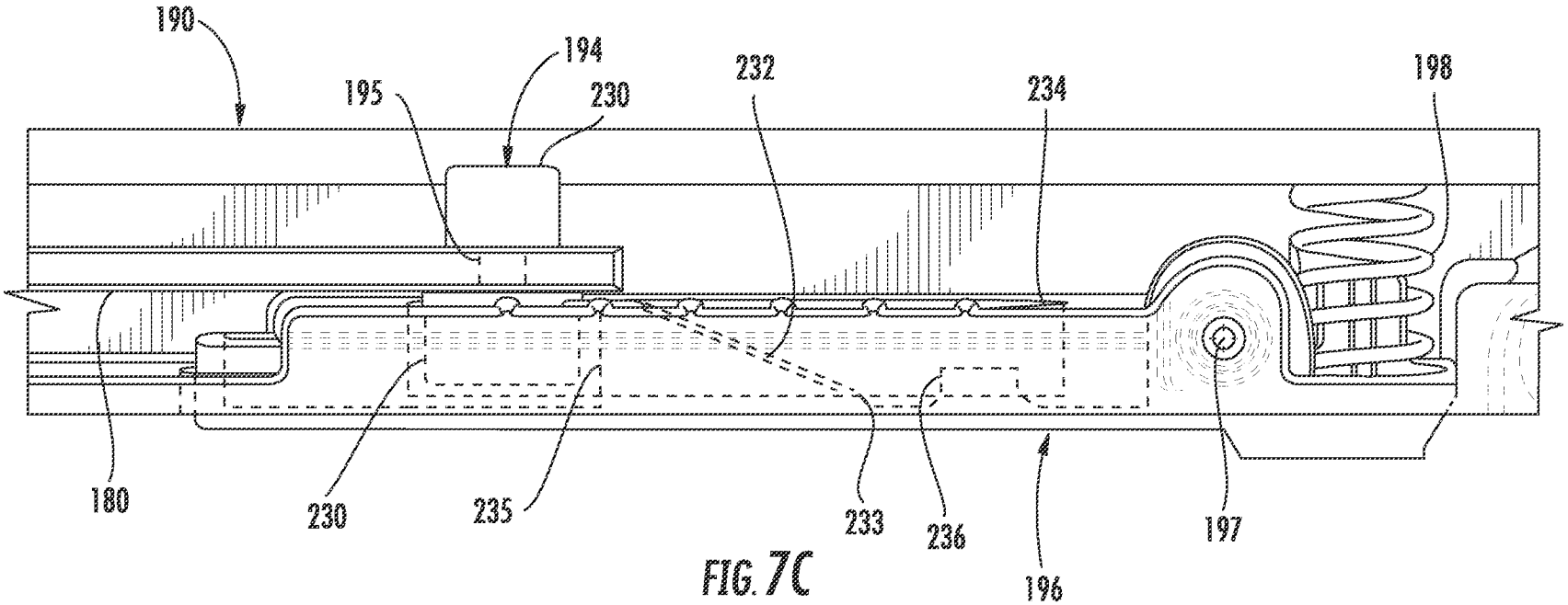
FIG. 7C is a close up, schematic, bottom plan view of a portion of the upper rim of FIG. 7A.

As shown in FIGS. 7B-7C, the upper, second ends 183 of the linkages 180 are coupled to the inside of the upper rim 190 through a button rim pin assembly 194. According to one embodiment, the pin assembly 194 includes a pin 195 and two wheels 230 positioned on the ends of the pin 195 on either side of the linkages 180. More specifically, one of the wheels 230 is positioned along one side of the linkage 180 and another wheel 230 is positioned along the other side of the linkage 180. The two wheels 230 are attached to each other and rotate about the pin 195 that extends through the upper, second end 183 of the linkage 180 and at least a portion of the wheels 230. The pin assembly 195 moves along a portion of the length of the upper rim 190. More specifically, the pin assembly 194 (with the upper, second ends 183 of the linkages 180) is positioned within and moves along the length of the slide slot 234 of the upper rim 190.

Upper Rim

Now referring to FIGS. 6A-8B, the upper rim 190 of the drying rack 100 is shown, according to an exemplary embodiment. The upper rim 190 includes a utensil band 202 and a wine glass rack 208.

Figure 6A:
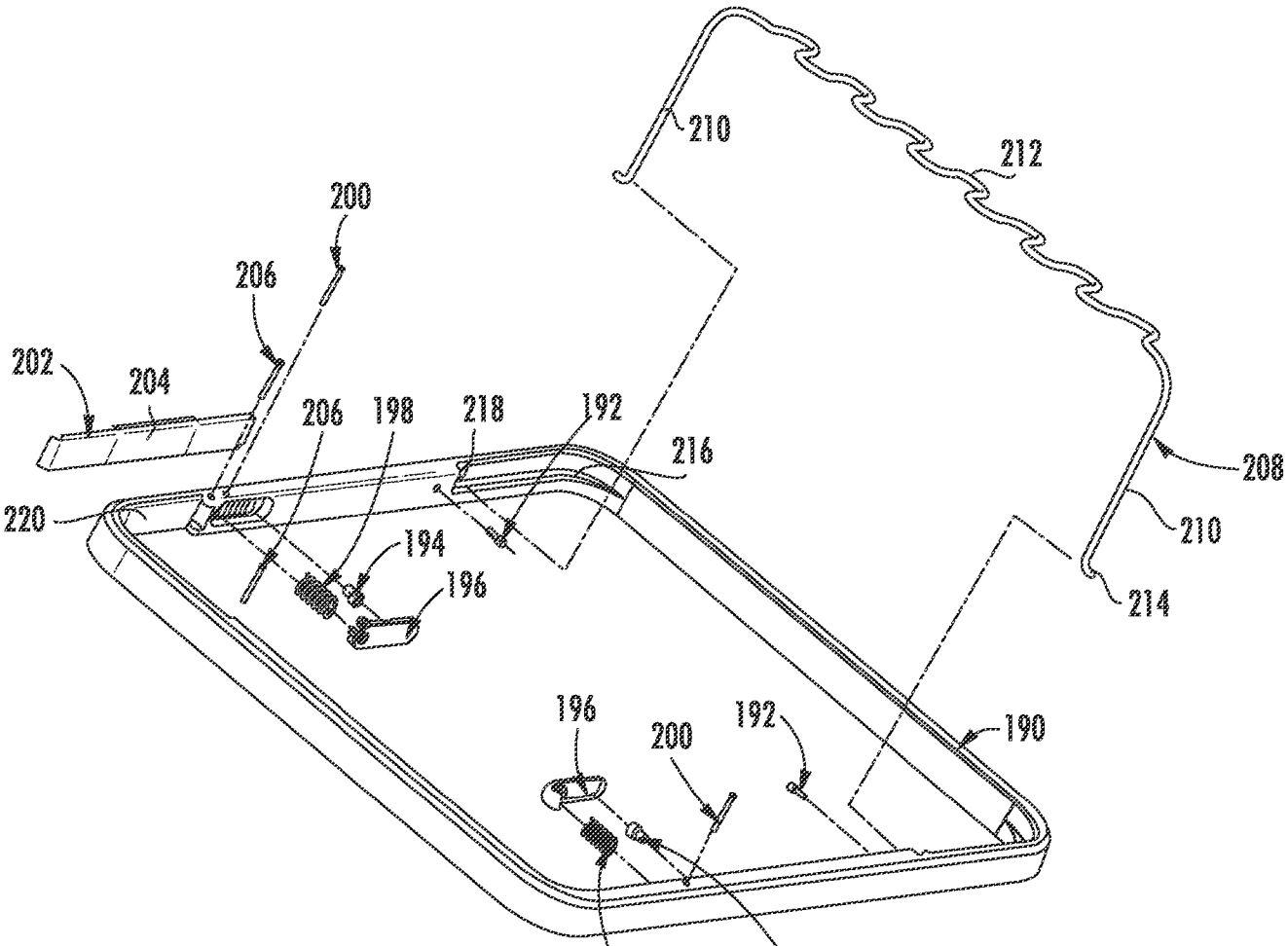
FIG. 6A is a perspective view of an upper rim of the drying rack assembly of FIG. 1, according to an exemplary embodiment.
Figure 6B:
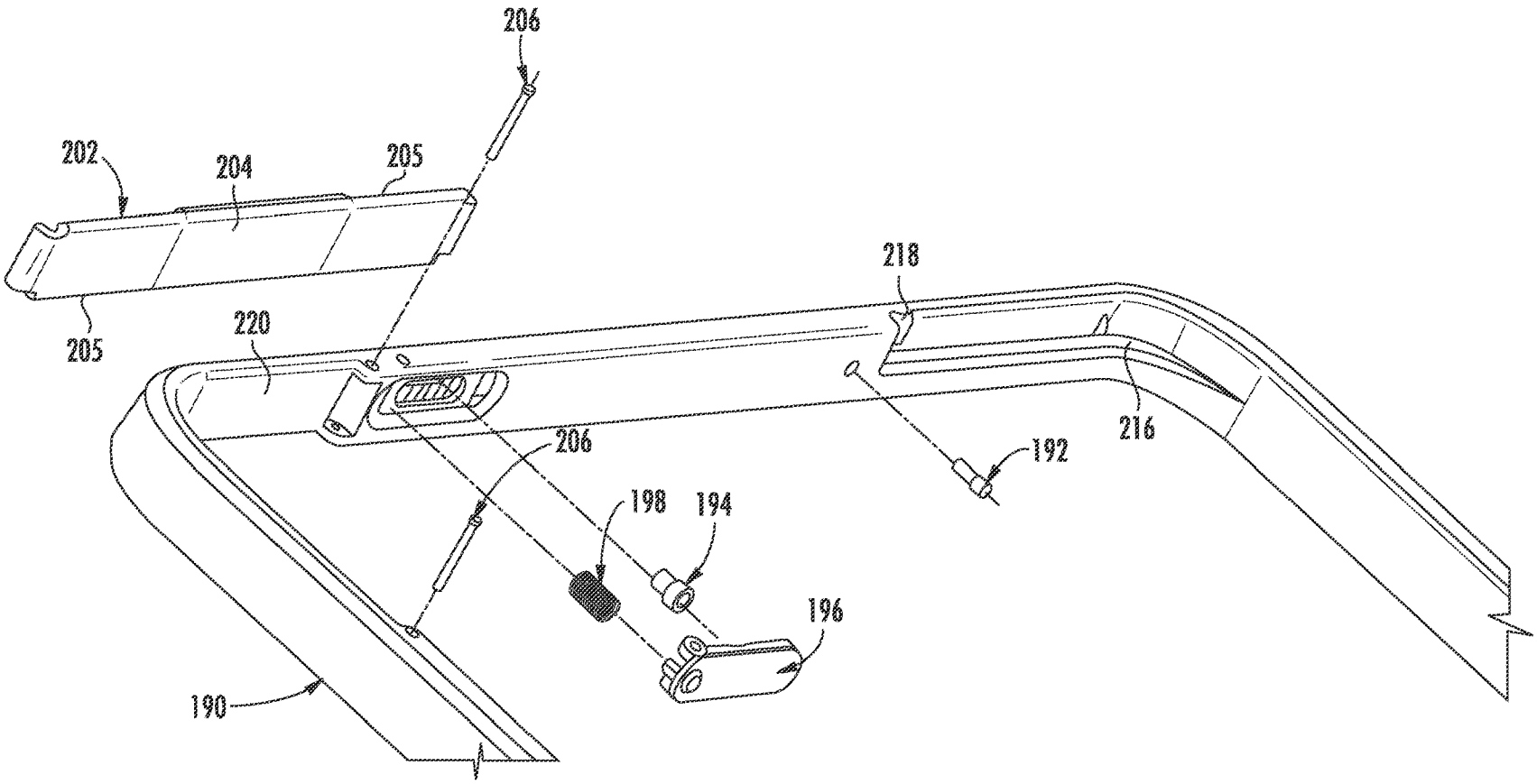
FIG. 6B is a close up view of a schematic of a portion of the upper rim of FIG. 6A, according to an exemplary embodiment.

The upper rim 190 is coupled to the upper, first ends 181 of the linkages 180 via rim pins 192 and the upper, second ends 183 via the button rim pin assembly 194 (as shown in FIGS. 6A-6B). The button rim pin assembly 194 allows or prevents actuation (and movement) of the linkages 180 when controls (referred to herein as buttons 196) are pushed or released, respectively. The buttons 196 are positioned along the upper rim 190 and also include springs 198 to provide automatic release of the buttons 196 (and therefore a ramp 232) when a force is no longer being applied. The buttons 196 are coupled to the upper rim 190 via button pins 200 (as shown in FIG. 6A). Movement of the buttons 196 causes the ramp 232 to move either directly or indirectly with the button 196. According to one embodiment, the ramp 232 is positioned directly on the inside surface of the button 196 in order to allow the ramp 232 to move congruently with the button 196.

FIGS. 7B-7C show the pivot point or rotational axis 197 that the button 196 rotates around as the button 196 is pushed. As described below, when the buttons 196 are pushed or pressed, the ramp 232 is moved, which allows the pin assembly 194 to pass over the ramp 232 and move along the length of the slide slot 234, which thus linearly moves the upper, second ends 183 of the linkages 180 along a portion of the length of the upper rim 190, releases the upper rim 190 from the extended position, and moves the upper rim 190 from the extended position to the collapsed position. When the buttons 196 are not pressed, the ramp 232 blocks the pin assembly 194 within the slot 234 and prevents the pin assembly 194 from moving within the slide slot 234, which locks the upper rim 190 in position.

The upper rim 190 houses the spring-loaded ramp 232 in a slide slot 234. The ramp 232 includes an angled surface extending between a first end 233 and a second end 235 of the ramp 232 and a substantially perpendicular (relative to the length and width of the slide slot 234) and flat surface at the second end 235 of the ramp 232. In some embodiments, there is a detent 236 within the slide slot 234 between the first end 233 of the ramp 232 and the rotational axis 197 of the button 196, extending upwardly into the slide slot 234 (optionally extending from the inside surface of the button 196). Due to the detent 236, when the upper rim 190 is in the closed, collapsed position, the detent 236 creates friction against one of the wheels 230 of the pin assembly 194 to help secure the pin assembly 194 within the slide slot 234 and thus keep and maintain the upper rim 190 in the closed, collapsed position during storage to prevent the upper rim 190 from drifting upward to the extended position.

In the collapsed position, the upper, second ends 183 of the linkages 180 are positioned toward the ends of the slide slot 234 such that the pin assembly 194 is positioned at the first end 233 of the ramp 232, near or on the detent 236. In order to move the upper rim 190 from the collapsed position to the extended position, the user can lift the upper rim 190. As the user lifts the upper rim 190 from the base 118, the upward force overcomes the friction between one of the wheels 230 and the detent 236, which allows the pin assembly 194 to move along the ramp 232. Specifically, one of the wheels 230 of the pin assembly 194 moves against the first end 233 of the ramp 232, along and up the angled surface of the ramp 232 within the slide slot 234, and to (and past) the second end 235 of the ramp 232. When the wheel 230 (and thus the pin assembly 194) moves from the first end 233, to the second end 235, and past the second end 235 of the ramp 232, the wheel 230 (and thus the pin assembly 194) subsequently falls behind the second end 235 of the ramp 232 (as shown in FIGS. 7B-7C), and the second end 235 of the ramp 232 blocks the pin assembly 194 on the upper, second end 183 of the linkage 180 from moving back within the slide slot 234, which locks the second end 183 of the linkage 180 into place along the slide slot 234 of the upper rim 190, thus locking and securing the upper rim 190 in the extended position. FIGS. 7A-7C show the linkages 180 positioning the upper rim 190 in the extended position.

To move the upper rim from the extended position to the collapsed position, the buttons 196, shown in FIG. 6A and 6B, are pushed or pressed against the force of the spring 198. As the buttons 196 are pressed and the spring 198 is compressed, the buttons 196 move or pivot about the rotational axis 197 (in the counter-clockwise direction with respect to FIG. 7C), which moves or pivots the ramp 232 out of position within the slide slot 234 (by either lowering the ramp 232 or moving the ramp 232 at least partially out of the slide slot 234) and allows the pin assembly 194 on the upper, second end 183 of the linkages 180 to move along the length of the ramp 232 from the second end 235 to the first end 233, and thus along the length of the slide slot 234 into the closed, collapsed position. According to one embodiment, the ramp 232 may also rotate about the rotational axis 197 with the button 196.

Utensil Band

As shown in FIGS. 6A-6B and 8A-8B, the utensil band 202 of the upper rim 190 of the drying rack 100 provides an upper support for the utensil compartment 170 such that when utensils are placed in the utensil compartment 170, the utensils remain in a substantially upright position. The utensil band 202 is coupled to the upper rim 190 via utensil band pins 206 (as shown in FIGS. 6A-6B) located on and extending through both ends of utensil band 202 and is spaced directly above and spaced apart from the utensil compartment 170 within the base 118 and, specifically, above the outer wall 176 (when in the extended position).

Figure 8A:
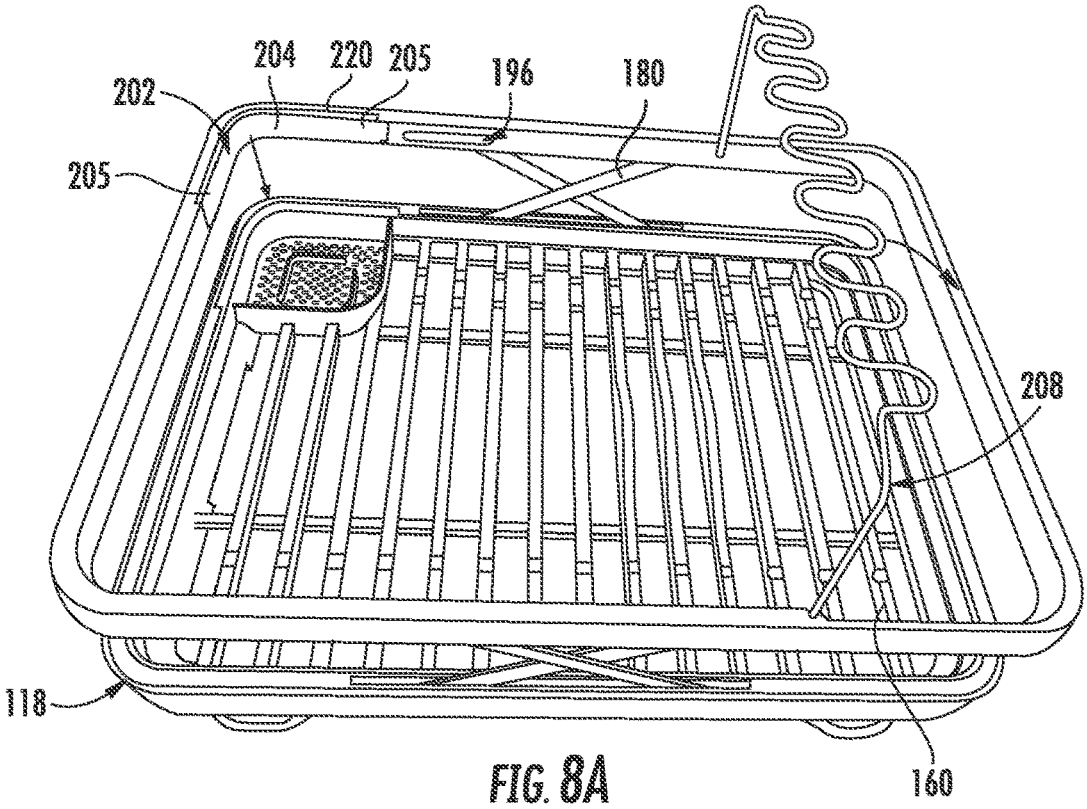
FIG. 8A is a perspective view of the drying rack of FIG. 1 in an expanded position, according to an exemplary embodiment.
Figure 8B:
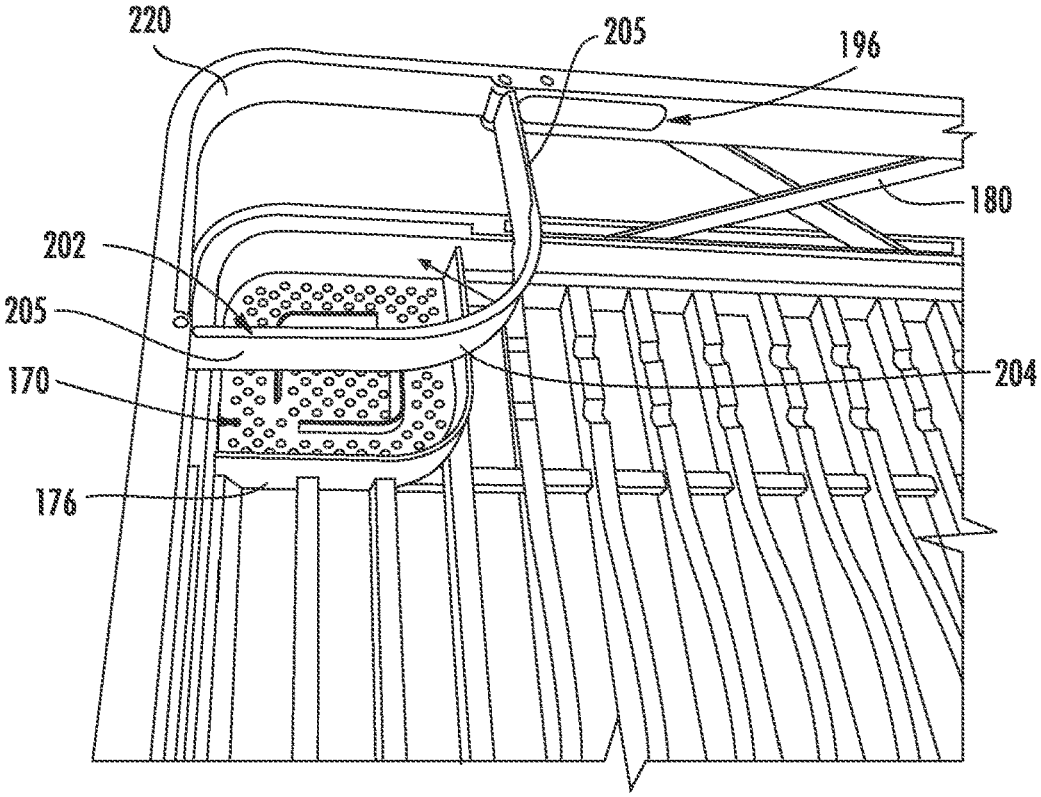
FIG. 8B is a close up of a utensil compartment of the drying rack of FIG. 1, according to an exemplary embodiment.

The utensil band 202 is movable between a first, stowed position and a second, extended position. The utensil band 202 includes a flexible center portion 204 and end portions 205 on either side of the center portion 204. The flexible center portion 204 is configured to be curved between the two end portions 205 in both the stowed position (as shown in FIG. 8A) and the extended position (as shown in FIG. 8B) such that the flexible center portion 204 forms a corner in both the stowed position and the extended position. In the stowed position, the center portion 204 is positioned within a corner of the inner sides of the upper rim 190 (within the utensil band indentation 220). The utensil band 202 may lie within a utensil band indentation 220 when the utensil band 202 is not in use and in the stowed position (as shown in FIG. 8A). In the extended position, the utensil band 202 is substantially aligned with the outer wall 176 of the utensil compartment 170.

In order to move the utensil band 202 between the stowed position and the extended position, the utensil band 202 is moved outwardly away from the upper rim 190 from the stowed position to the extended position (as shown in FIG. 8A) or inwardly toward the upper rim 190 from the extended position to the stowed position (as shown in FIG. 8B) relative to the upper rim 190. In the stowed position (as shown in FIG. 8A), the utensil band 202 is flush against an inner edge of the upper rim 190 within the utensil band indentation 220.

In order to move the utensil band 202 between the stowed position and the extended position, the center portion 204 is inverted inwardly or outwardly. For example, when the utensil band 202 is going to be used, a force is applied to the utensil band 202 to move the utensil band 202 away from the utensil band indentation 220. As the utensil band 202 is moved, the center portion 204 of the utensil band 202 that is curved inverts outwardly in a horizontal manner and the end portions 205 rotate about the utensil band pins 206 to move and secure the utensil band 202 outward away from the utensil band indentation 220, thus creating a four sided compartment with the inner sides of the upper rim 190 in order to hold utensils. Due to the configuration of the utensil band 202, the utensil band 202 does not have to move vertically in order to move between the stowed position and extended position.

Wine Glass Rack

Figure 9:
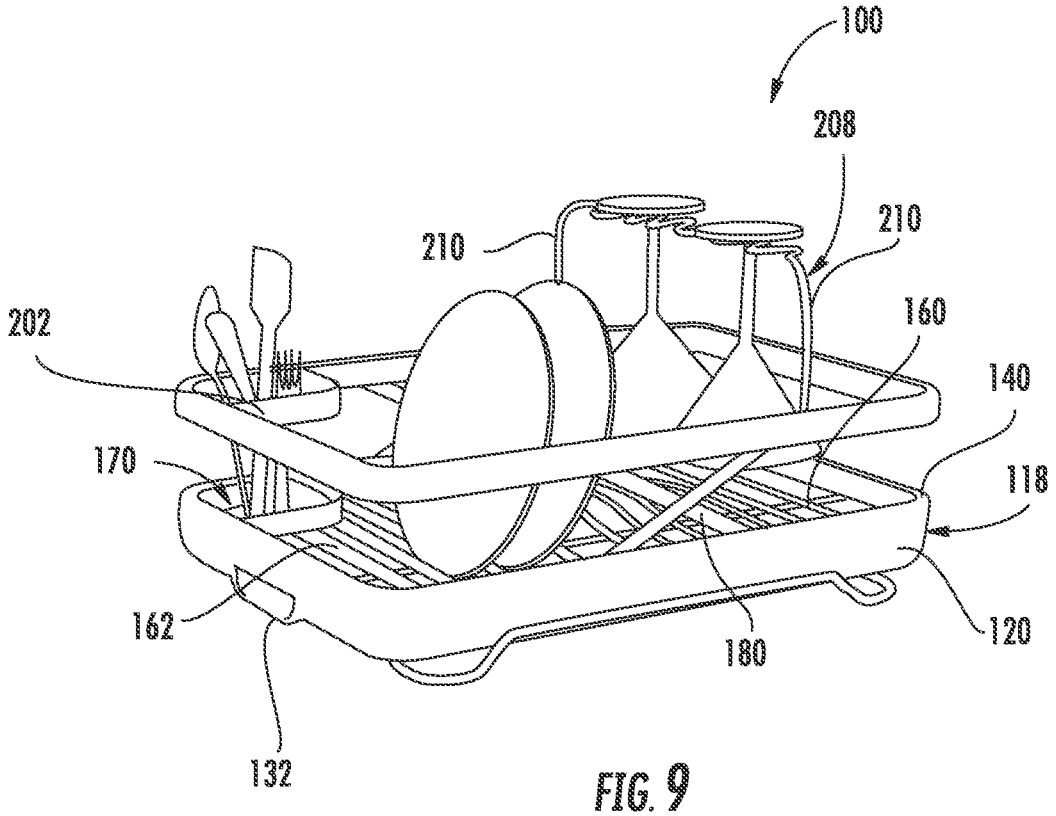
FIG. 9 is a perspective view of the drying rack of FIG. 1 in an expanded position using select features, according to an exemplary embodiment.

As shown in FIG. 9, the wine glass rack 208 of the upper rim 190 of the drying rack 100 allows wine glasses, or other stemmed glasses to hang without coming into contact with the first tray 160 when the wine glass rack 208 is in an upright position and the linkages 180 are extended. The wine glass rack 208 is moveable between a storage position (as shown in FIG. 5C) and an upright position (as shown in FIG. 8A). As shown in FIG. 6A, the wine glass rack 208 includes stems 210 which define a height of the wine glass rack 208 in the upright position. The wine glass rack 208 includes a holding portion 212 that extends between the stems 210 and defines openings for stems of wine glasses to be placed and a surface to support bases of wine glasses. For example, the holding portion 212 may be sinusoidal shaped, a structure with altering peaks and valleys, a center bar with perpendicular members extending therefrom, etc. The wine glass rack 208 is coupled to the upper rim 190 via curved portions 214. Curved portions 214 enter apertures on the upper rim 190 and provide an axis of rotation for the wine glass rack 208 to move from a storage position to the upright position.

In order to move the wine glass rack 208 between the storage position and the upright position, the wine glass rack 208 is rotated upwards from the storage position to the upright position (as shown in FIG. 5C) or downwards from the upright position to the storage position (as shown in FIG. 8A) relative to the upper rim 190. When in the storage position (as shown in FIG. 5B), the wine glass rack 208 sits on wine rack storage ledges 216 (as shown in FIG. 6A), which are indentation on the upper rim 190 to prevent the wine glass rack 208 from rotating past the upper rim 190. In the storage position, the steps 210 are substantially parallel to and directly next to (or abutting) the sides of the upper rim 190 and the holding portion 212 extends substantially parallel to and directly next to (or abutting) the end of the upper rim 190 in order to fold or rotate completely out of the way and to maximize the available space within the drying rack 100.

When in an upright position (as shown in FIG. 8A), the wine glass rack 208 is secured vertically (with the stems 210 substantially vertical) by locking the end of the stems 210 in the vertical lock groove 218 located on the upper rim 190. The vertical lock groove 218 is a groove surrounded by two ridges such that a force is needed to move the stems 210 of the wine glass rack 208 over the ridge to reside in the vertical lock groove 218. An equal force is needed to move the wine glass rack 208 over the ridge to leave the vertical lock groove 218 and move into the storage position. This allows the wine glass rack 208 to maintain and stay in an upright position when in use without risk of rotation.

Drying Rack in Use

FIG. 9 is a perspective view of the drying rack 100 of FIG. 1 using select features, according to an exemplary embodiment. The drying rack 100 has the linkages 180 in the expanded position such that the upper rim 190 and the base 118 are separate from one another and the upper rim 190 is extended above the base 118. The utensil band 202 is positioned within its extended position to provide an upper support for the utensils placed in the utensil compartment 170. The first tray 160 and the second tray 162 are in the inner base rim 140 to allow plates to sit and be held upright in different slots within in the drying rack 100. In addition, the wine glass rack 208 is in the upright position to allow glasses to hang and dry.

Figure 10:
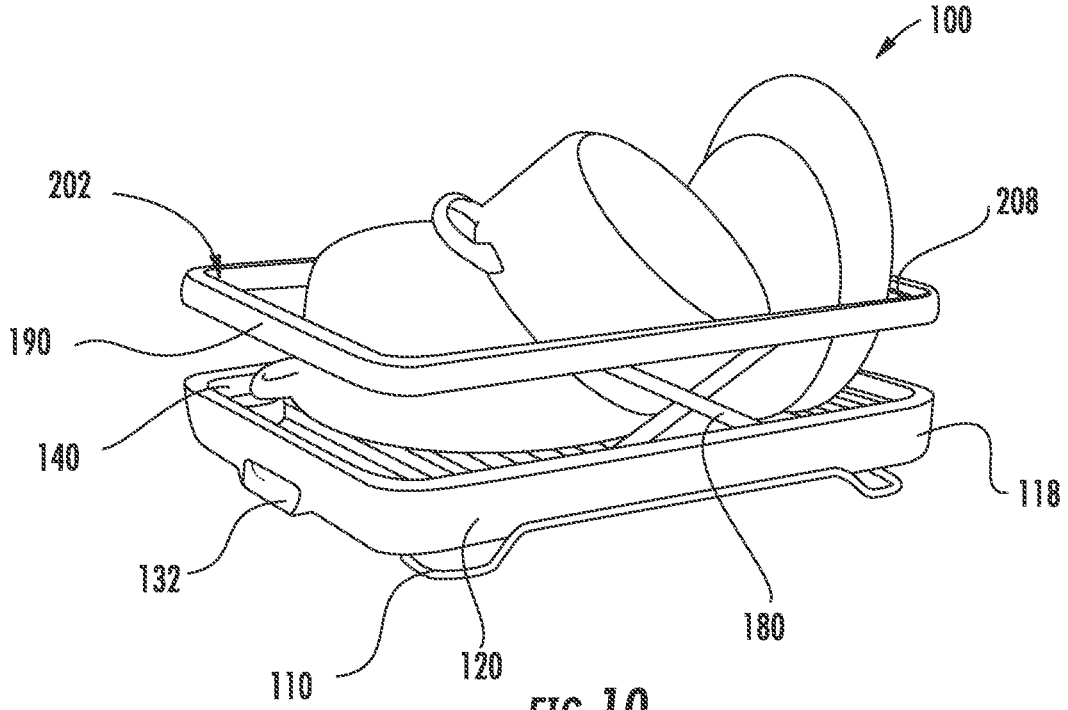
FIG. 10 is a perspective view of the drying rack of FIG. 1 in an expanded position using select features, according to an exemplary embodiment.

FIG. 10 is a perspective view of the drying rack 100 of FIG. 1 using select features, according to an exemplary embodiment. The drying rack 100 has the linkages 180 in the expanded position such that the upper rim 190 and the base 118 are separate from one another and the upper rim 190 is extended above the base 118. The utensil band 202 and the wine glass rack 208, however, are both folded or rotated away in their respective stowed or storage positions, respectively, to allow the large pots and pans to fit in the drying rack 100 to accommodate the large pots and pans instead of providing areas for utensil or wine glass drying. The first tray 160 and the second tray 162 are in the inner base rim 140 to allow the large pots and pans to sit in the drying rack 100 and allow water dripping off them to fall into the base 118 and exit the base 118 through the draining spout 132. The stand wires 110 position the draining spout 132 of the drying rack 100 above a lip of a sink and to keep the a lower portion of the base 118 of the drying rack 100 level with the lip of the sink.

Figure 11:
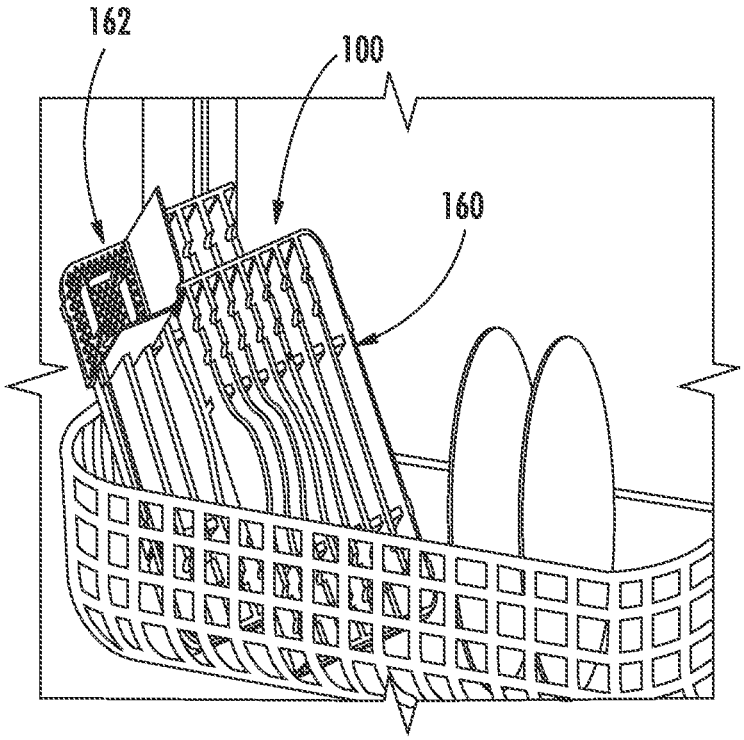
FIG. 11 is a perspective view of the drying rack of FIG. 1 disassembled within a dishwasher.
Figure 12:
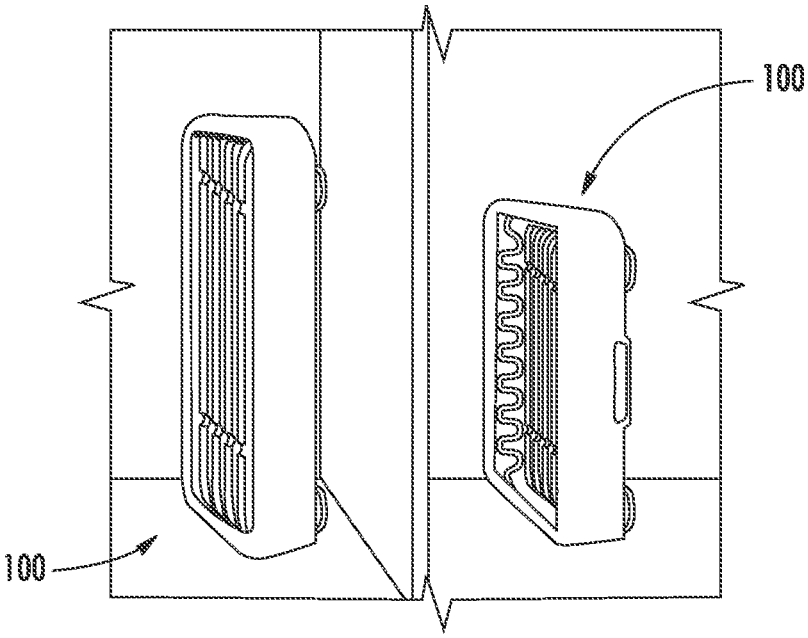
FIG. 12 is a perspective view of the drying rack of FIG. 1 in a collapsed position lying on its end and the drying rack of FIG. 1 in a collapsed position lying on its side.

As shown in FIG. 11, the drying rack can be disassembled and the first tray 160 and the second tray 162 can be removed from the rest of the drying rack 100 in order to be washed in a dishwasher. As shown in FIG. 12, the drying rack 100 can be stored on its side or end for easy storage. When the drying rack 100 is stored, the linkages 180 may be moved to the collapsed position and the wine glass rack 208 may be moved to the storage position in order to made the drying rack 100 more compact for storage (as further shown in FIG. 5C).

According to any embodiment a drying rack includes a base (that includes an outer base shell and an inner base rim), stand wires, a first tray, a second tray, a utensil compartment, linkages, an upper rim, a utensil band and a wine glass rack. However, other embodiments may include or omit certain components to suit particular applications.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the overflow protection commercial toilets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the disclosure.

Other substitutions, modifications, changes and omissions may also be made in the design, operating conditions and arrangement of the various exemplary embodiments without departing from the scope of the present disclosure. For example, any element (e.g., base, linkages, removable trays, upper rims, utensil band and compartment, wine glass drying rack, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the disclosure.

The invention claimed is:

1. A selectively deployable drying rack with selectively reconfigurable components comprising:

a base comprising a bottom wall and a drainage hole, wherein the bottom wall is configured to direct fluid toward the drainage hole;

an upper rim;

a deployment mechanism to move the upper rim between an expanded position and a collapsed position with respect to the base; and a tray that is positioned at least partially within the base and between the upper rim and the bottom wall of the base in both the expanded position and the collapsed position.

2. The drying rack of claim 1, wherein the deployment mechanism comprises a linkage extending between the upper rim and the base and a spring-loaded ramp in a slide slot and comprising a first end and a second end, wherein the second end of the linkage is coupled to a pin assembly that moves along the spring-loaded ramp within the slide slot when the upper rim is moved from the collapsed position to the expanded position.

3. The drying rack of claim 2, wherein the deployment mechanism further comprises controls such that, when the controls are pressed, the ramp is moved and allows the pin assembly to move along the length of the slide slot such that the upper rim is moved from the expanded position to the collapsed position.

4. The drying rack of claim 3, wherein, when the controls are not pressed, the pin assembly cannot move within the slide slot and the upper rim is locked in a position.

5. The drying rack of claim 3, wherein the deployment mechanism further comprises a detent such that, when in the collapsed position, the detent creates friction against the pin assembly to maintain the upper rim in the collapsed position.

6. The drying rack of claim 1, wherein the deployment mechanism comprises two pairs of linkages that each comprise a first linkage and a second linkage and each extend between the upper rim and the base.

7. The drying rack of claim 6, wherein the first linkage comprises an upper, first end and a lower, second end, and the second linkage comprises a lower, first end and an upper, second end, wherein the base comprises a linkage slot, wherein the lower, second end of the first linkage is slidably and rotatably attached to the linkage slot of the base and can move along the length of the linkage slot.

8. The drying rack of claim 1, wherein the tray is a first removable tray and further comprising a second removable tray, wherein the first removable tray and the second removable tray are configured to fit within the base.

9. The drying rack of claim 8, wherein the first tray and the second tray each have a plurality of cross bars, wherein a height of the cross bars along a center portion of the first tray and the second tray is larger than a height of the cross bars along edge portions of the first tray and the second tray.

10. The drying rack of claim 8, wherein the first tray and the second tray interlock with each other such that the first tray partially overlaps a portion of the second tray.

11. The drying rack of claim 8, wherein the second tray comprises a utensil compartment comprising holes that extend through the second tray, an outer wall, and an inner wall.

12. The drying rack of claim 1, wherein the upper rim comprises a utensil band that is moveable between a stowed position and an extended position.

13. The drying rack of claim 12, wherein the utensil band is positioned directly above and spaced apart from a utensil compartment within the base.

14. The drying rack of claim 1, wherein the upper rim comprises a wine glass rack that is moveable between a storage position and an upright position.

15. The drying rack of claim 1, further comprising a stand wire to elevate the base of the drying rack above a surface.

16. The drying rack of claim 1, wherein the tray is configured to support at least one dish in a vertical position.

17. The drying rack of claim 1, wherein the tray is removable from the base.

18. The drying rack of claim 1, wherein the tray is positionable at least partially within the base both when the upper rim is in the expanded position and when the upper rim is in the collapsed position.

19. The drying rack of claim 1, wherein the tray defines a plurality of through-holes that are configured to allow fluid to drain through the tray.

20. The drying rack of claim 1, wherein the bottom wall of the base is angled downward toward the drainage hole.

21. A selectively deployable drying rack with selectively reconfigurable components comprising:

a base;

an upper rim; and a deployment mechanism to move the upper rim between an expanded position and a collapsed position with respect to the base, wherein the deployment mechanism comprises a linkage extending between the upper rim and the base and a spring-loaded ramp in a slide slot and comprising a first end and a second end, wherein the second end of the linkage is coupled to a pin assembly that moves along the spring-loaded ramp within the slide slot when the upper rim is moved from the collapsed position to the expanded position, wherein the ramp comprises an angled surface extending between a first end and a second end of the ramp and a substantially perpendicular and flat surface at the second end of the ramp such that when the pin assembly moves from the first end to the second end of the ramp and past the second end, the pin assembly falls behind the second end of the ramp such that the upper rim is secured in the expanded position.

22. The drying rack of claim 21, wherein, when the upper rim is moved from the collapsed position to the expanded position, the pin assembly moves up the angled surface of the ramp and past the second end of the ramp.

23. A selectively deployable drying rack with selectively reconfigurable components comprising:

a base;

an upper rim; and a deployment mechanism to move the upper rim between an expanded position and a collapsed position with respect to the base, wherein the upper rim comprises a utensil band that is moveable between a stowed position and an extended position, wherein the utensil band comprises a flexible center portion that forms a corner in both the stowed position and the extended position.

24. The drying rack of claim 23, wherein, in order to move the utensil band between the stowed position and the extended position, the center portion is inverted.

* * * * *